US011187482B2

(12) United States Patent
Bloomfield

(10) Patent No.: US 11,187,482 B2
(45) Date of Patent: Nov. 30, 2021

(54) TRIGGER ASSEMBLY

(71) Applicant: Pressure Break, LLC, Fort Worth, TX (US)

(72) Inventor: Nicholas Bloomfield, Kirtland, NM (US)

(73) Assignee: Pressure Break, LLC, Fort Worth, TX (US)

( * ) Notice: Subject to any disclaimer, the term of this patent is extended or adjusted under 35 U.S.C. 154(b) by 0 days.

(21) Appl. No.: 16/836,756

(22) Filed: Mar. 31, 2020

(65) Prior Publication Data

US 2021/0302117 A1 Sep. 30, 2021

(51) Int. Cl.
*F41A 17/46* (2006.01)
*F41A 19/10* (2006.01)

(52) U.S. Cl.
CPC ..... *F41A 17/46* (2013.01); *F41A 19/10* (2013.01)

(58) Field of Classification Search
CPC ..... F41A 17/46; F41A 19/10
USPC ..... 42/70.06
See application file for complete search history.

(56) References Cited

U.S. PATENT DOCUMENTS 4,276,868 A 7/1981 Burrows et al.
4,440,064 A 4/1984 Stehlik
4,532,852 A 8/1985 Hance et al.
4,685,379 A 8/1987 Troncoso
4,718,187 A 1/1988 Blake
4,787,288 A 11/1988 Miller
4,803,910 A 2/1989 Troncoso
5,025,582 A * 6/1991 Mote, Sr. ..... F41A 17/46 42/70.06
5,074,190 A 12/1991 Troncoso
5,359,799 A 11/1994 Moon
5,780,762 A 7/1998 Kobayashi
5,852,891 A 12/1998 Onishi et al.
5,954,507 A 9/1999 Rod et al.
6,101,918 A 8/2000 Akins
6,173,518 B1 * 1/2001 Oberst ..... F41A 17/02 42/70.06
6,223,644 B1 5/2001 Troncoso
6,354,032 B1 3/2002 Viani
6,499,243 B1 12/2002 Herzog
6,651,642 B1 11/2003 Powers
7,073,284 B2 7/2006 Monks et al.
7,089,697 B2 8/2006 Monks
(Continued)

FOREIGN PATENT DOCUMENTS

DE 20 2005 012266 U1 2/2006
EP 1469274 A1 10/2004

OTHER PUBLICATIONS

PPQ M2, Walther—Built for Life.—available as of Oct. 6, 2015, http://www.waltherarms.com/products/ppg-m2/.
(Continued)

*Primary Examiner* — Samir Abdosh
(74) *Attorney, Agent, or Firm* — Knobbe, Martens, Olson & Bear, LLP

(57) ABSTRACT

A trigger assembly for a firearm can include a trigger safety member to prevent unintentional firing of the firearm. The trigger safety member is designed to facilitate engaging with the digit of the user, while preventing accidental unlocking of the trigger safety member. The trigger can also include one or more kinesthetic features.

24 Claims, 12 Drawing Sheets

(56) References Cited

U.S. PATENT DOCUMENTS

| | | | | |
|---|---|---|---|---|
| 7,252,504 | B2 * | 8/2007 | Lin | F23Q 2/164 431/153 |
| D597,626 | S | 8/2009 | Krieger | |
| 7,854,084 | B1 | 12/2010 | Rutherford | |
| 7,992,338 | B2 | 8/2011 | Bowman | |
| 8,036,704 | B2 | 10/2011 | Werner | |
| 8,099,895 | B2 | 1/2012 | Shelton et al. | |
| 8,220,193 | B1 | 7/2012 | Lynch | |
| 8,234,969 | B2 | 8/2012 | Beckmann | |
| 8,250,799 | B2 * | 8/2012 | Duperry | F41A 19/16 42/70.04 |
| 8,539,707 | B1 | 9/2013 | Di Trolio | |
| 8,572,878 | B2 | 11/2013 | Gentilini | |
| 8,615,915 | B2 | 12/2013 | Hunter et al. | |
| 8,656,619 | B2 | 2/2014 | Popikov | |
| 8,881,442 | B2 | 11/2014 | Elftmann, Jr. | |
| 9,046,313 | B1 | 6/2015 | Lutton | |
| 9,696,104 | B1 | 7/2017 | Bloomfield | |
| 10,247,503 | B2 | 4/2019 | Bloomfield | |
| 10,317,158 | B2 * | 6/2019 | Geissele | F41A 19/10 |
| 10,317,159 | B2 * | 6/2019 | Zajk | F41A 17/56 |
| 10,429,143 | B2 * | 10/2019 | Zajk | F41A 17/56 |
| 10,767,950 | B2 * | 9/2020 | Lake | F41A 17/46 |
| 10,801,794 | B2 * | 10/2020 | Geissele | F41A 19/10 |
| 2003/0213159 | A1 * | 11/2003 | Cutini | F41A 17/46 42/70.06 |
| 2008/0115660 | A1 | 5/2008 | Hensel | |
| 2009/0158922 | A1 | 6/2009 | Werner | |
| 2010/0024273 | A1 * | 2/2010 | Duperry | F41A 19/10 42/69.01 |
| 2011/0079137 | A1 | 4/2011 | Audibert et al. | |
| 2011/0167691 | A1 | 7/2011 | Bowman | |
| 2012/0117841 | A1 | 5/2012 | Joubert | |
| 2012/0117842 | A1 | 5/2012 | Popikov | |
| 2013/0340309 | A1 | 12/2013 | Lee | |
| 2014/0007763 | A1 | 1/2014 | Foster | |
| 2015/0153125 | A1 | 6/2015 | Lutton | |
| 2015/0292828 | A1 * | 10/2015 | Nebeker | F41A 17/56 42/69.01 |
| 2015/0330734 | A1 * | 11/2015 | Kolev | F41A 3/46 42/69.01 |
| 2016/0084600 | A1 | 3/2016 | Siddle | |
| 2017/0045325 | A1 | 2/2017 | Johnson | |
| 2017/0284756 | A1 | 10/2017 | Bloomfield | |
| 2018/0080731 | A1 * | 3/2018 | Hudson, III | F41A 17/46 |
| 2020/0124370 | A1 * | 4/2020 | Kolev | F41A 19/16 |

OTHER PUBLICATIONS

Daiker, Duane A., Beretta Nano Micro 9mm Pocket Pistol—Newgun Review, Guns America, May 6, 2013, http://www.gunsamerica.com/blog/baretta-nano-micro-9mm-pocket-pistol-new-gun-review/.

Sagi, Guy, Ruger SR40 Gallery, Shooting Illustrated, Apr. 22, 2011, http://www.shootingillustrated.com/index.php/8563/ruger-sr40/.

PCT Search Report and Written Opinion dated Feb. 19, 2018, Application No. 2017/038248, Pressure Break, LLC, 20 pages.

* cited by examiner

TRIGGER ASSEMBLY

BACKGROUND

Field

The present invention relates generally to triggers, and more specifically to a triggers used for firing weapons, and a safety mechanism to prevent accidental discharge of the weapons.

Description of the Related Art

In order to prevent accidental discharge of firearm weapons, one or more safety mechanisms are needed. In some cases, such prevention of accidental discharge of firearm weapons can be, and often are, achieved by safety mechanisms which can mechanically inhibit actuation of a trigger of the firearm weapons when inadvertently engaged.

SUMMARY

Accordingly, there is in the need of the art for improved triggers assembly with safety mechanisms, used for firing weapons, and weapons including such triggers, among other things.

In accordance with one aspect of the present disclosure, a trigger assembly includes a trigger body, a trigger safety member, and a resilient member. The trigger body has an elongated shape with a front surface that extends across a width between a left edge and a right edge. The trigger body is configured to be pivotally coupled to a firearm housing, and the trigger body has a slot between the left edge and the right edge. The trigger safety member is pivotally coupled to the trigger body. The trigger safety member extends between a proximal end and a distal end, and the distal end includes a curved surface configured to be engaged by a digit of a user to allow pivoting of the trigger body when pulling on the trigger. The resilient member is disposed between a portion of the trigger body and a portion of the trigger safety member. The resilient member is configured to bias the trigger safety member in a first direction to an extended position such that the distal end of the trigger safety member extends through the slot and protrudes distally of the front surface and the proximal end of the trigger safety member protrudes proximally of a rear surface of the trigger body to inhibit pivoting of the trigger body relative to the firearm housing past a predetermined position. When engaged by the digit of the user, the trigger safety member is configured to pivot in a second direction opposite the first direction to allow the trigger body to pivot past the predetermined position when pulling on the trigger.

The trigger assembly of any of the preceding paragraphs and/or any of the trigger assemblies disclosed herein can include one or more of the following features. The curved surface can be a convex surface. The convex surface can be a circular surface. The resilient member can include a spring. The spring can be a coil spring. The resilient member can be disposed between a proximal portion of the trigger safety member adjacent the proximal end of the trigger safety member and a portion of the trigger body. The trigger safety member can be pivotally coupled to the trigger body about a first axis. The trigger body can include a pair of spaced apart protrusions that extend distally of the front surface of the trigger body, so that a central portion of the front surface extends between the pair of protrusions and so that the slot extends between the pair of protrusions, and the pair of spaced apart protrusions can be configured to be engaged by the digit of the user to pull the trigger and provide two points of contact to increase mechanoreceptor stimulation in the digit. One of the pair of spaced apart protrusions can be proximate the left edge and the other of the pair of spaced apart protrusions can be proximate the right edge, and the pair of spaced apart protrusions can be configured to prevent user contact with the central portion of the front surface of the trigger body. The distal end of the trigger safety member can protrude past the pair of spaced apart protrusions in the extended position. A portion of the trigger safety member that protrudes in front of the front surface in the extended position can have a length that is approximately ¼ or less of a length of the front surface of the trigger body. The trigger safety member can protrude in front of a lower portion of the front surface adjacent a lower end of the front surface of the trigger body. The trigger safety member can include glass filled nylon.

In accordance with another aspect of the present disclosure, a firearm includes a firearm housing, a trigger body, a trigger safety member, and a resilient member. The trigger body has an elongated shape with a front surface that extends across a width between a left edge and a right edge. The trigger body is configured to be pivotally coupled to the firearm housing, and the trigger body has a slot between the left edge and the right edge. The trigger safety member is pivotally coupled to the trigger body. The trigger safety member extends between a proximal end and a distal end, and the distal end includes a curved surface configured to be engaged by a digit of a user to allow pivoting of the trigger body when pulling on the trigger. The resilient member is disposed between a portion of the trigger body and a portion of the trigger safety member. The resilient member is configured to bias the trigger safety member in a first direction to an extended position such that the distal end of the trigger safety member extends through the slot and protrudes distally of the front surface and the proximal end of the trigger safety member protrudes proximally of a rear surface of the trigger body to inhibit pivoting of the trigger body relative to the firearm housing past a predetermined position. When engaged by the digit of the user, the trigger safety member is configured to pivot in a second direction opposite the first direction to allow the trigger body to pivot past the predetermined position when pulling on the trigger.

The firearm of any of the preceding paragraphs and/or any of the firearms disclosed herein can include one or more of the following features. The curved surface can be a convex surface. The convex surface can be a circular surface. The resilient member can include a spring. The spring can be a coil spring. The resilient member can be disposed between a proximal portion of the trigger safety member adjacent the proximal end of the trigger safety member and a portion of the trigger body. The trigger safety member can be pivotally coupled to the trigger body about a first axis. The trigger body can include a pair of spaced apart protrusions that extend distally of the front surface of the trigger body, so that a central portion of the front surface extends between the pair of protrusions and so that the slot extends between the pair of protrusions, and the pair of spaced apart protrusions can be configured to be engaged by the digit of the user to pull the trigger and provide two points of contact to increase mechanoreceptor stimulation in the digit. One of the pair of spaced apart protrusions can be proximate the left edge and the other of the pair of spaced apart protrusions can be proximate the right edge, and the pair of spaced apart protrusions can be configured to prevent user contact with the central portion of the front surface of the trigger body.

The distal end of the trigger safety member can protrude past the pair of spaced apart protrusions in the extended position. A portion of the trigger safety member that protrudes in front of the front surface in the extended position can have a length that is approximately ¼ or less of a length of the front surface of the trigger body. The trigger safety member can protrude in front of a lower portion of the front surface adjacent a lower end of the front surface of the trigger body. The trigger safety member can include glass filled nylon.

BRIEF DESCRIPTION OF THE DRAWINGS

Various embodiments are depicted in the accompanying drawings for illustrative purposes, and should in no way be interpreted as limiting the scope of the inventions, in which like reference characters denote corresponding features consistently throughout similar embodiments.

DETAILED DESCRIPTION

Figure 1:
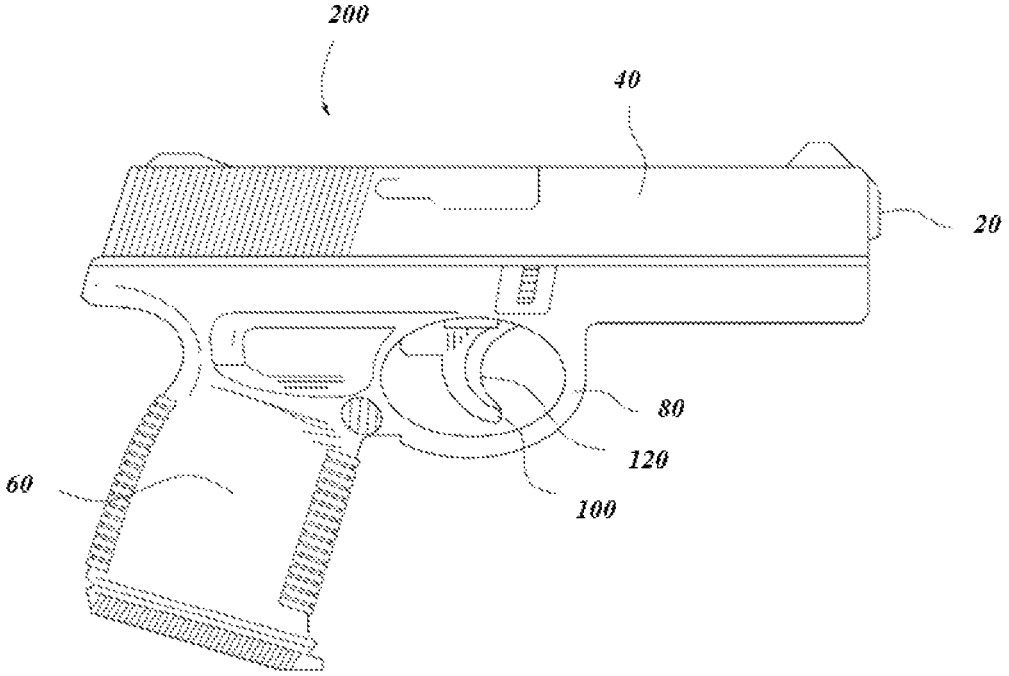
FIG. 1 illustrates a firearm weapon.

FIG. 1 illustrates a firearm weapon 200, which is shown in the form of a handgun. The weapon 200 may include a barrel 20, a grip 60, and a trigger assembly 100. In the illustrated embodiment, the weapon 200 also includes a slide 40 and a trigger guard 80. In some embodiment, the trigger assembly 100 includes kinesthetic features 120, for example in the form of a pair of protrusions and/or parallel bars, though other types of kinesthetic features could also be used as described herein. It will be understood that the principles described herein, in particular the improved trigger, can be used with any number of different systems. For example, the improved trigger can be used with any type of weapon with a trigger, such as handguns, rifles, shotguns, stun guns, railguns, crossbows, etc.

Figure 2:
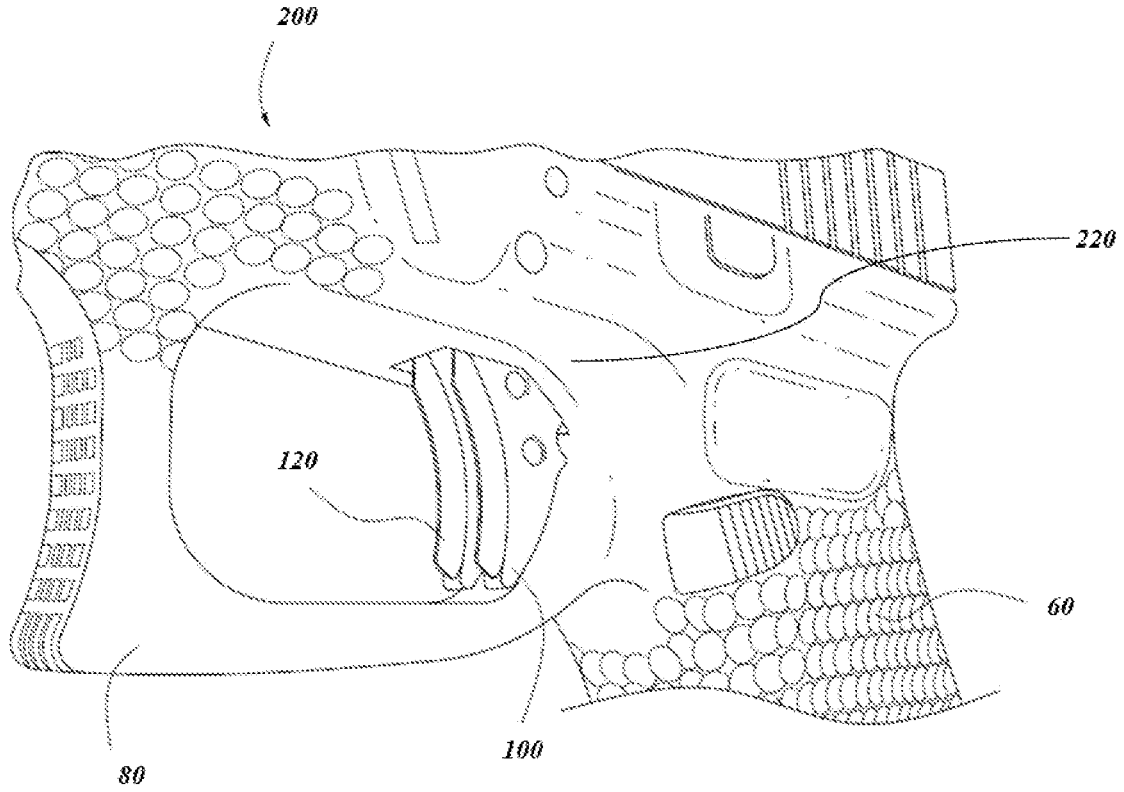
FIG. 2 illustrates a perspective view of a trigger assembly on a firearm weapon.

A detail view of the trigger assembly 100 mounted on a firearm housing 220 of the weapon 200 according to some embodiments is shown in FIG. 2. In some embodiments, the trigger assembly 100 includes the kinesthetic features 120 to provide increased mechanoreceptor stimulation to give a shooter increased kinesthetic awareness of the trigger pull. The trigger assembly 10 can include any number of different kinesthetic features 120 in different configurations, such as ridges, grooves, bumps or depressions, raised or depressed surfaces, bars, etc. These features can provide an increased sense of feel to encourage the straight, even, efficient and/or consistent pressing of the weapon's trigger to produce consistent and accurate shot placement.

In the illustrated embodiment, the trigger assembly 100 includes a pair of spaced apart protrusions 120 on the trigger face. With the addition of the spaced apart protrusions 120 on the trigger face, an operator is able to feel how pressure is being distributed across the face of the trigger during manipulation. The two raised points of contact or "parallel bars" allow the operator increased sensitivity in the pad of the trigger manipulation finger. This mechanoreceptor stimulation provides the operator additional information to help them evenly distribute mechanical pressure across the face of the trigger. This kinesthetic awareness and feedback is present while the operator's finger is applying rearward pressure to the face of the trigger. This can provide the operator with additional information to help produce a straight, even, and consistent press of the trigger. This can also help reduce pulling the weapon to one side during the trigger pull as pressure is not being applied unevenly to one side or the other of the trigger.

As will be understood, different weapons may employ triggers of different sizes and/or shapes. The face of the trigger—which is on the side of the trigger designed to be engaged by a digit of an operator—generally has some curvature to it, though the extent of the curvature can vary greatly. In addition, some triggers have a face that is predominately flat with little to no curvature. Among other movements, a trigger can be coupled to the weapon so as to pivot and/or slide with respect to the rest of the weapon when pulled. The kinesthetic features 120 can be provided on any of these different trigger designs. For example, the face of the trigger 100 illustrated in FIG. 1 has a different shape and curvature than the trigger 100 illustrated in FIG. 2, while still employing the kinesthetic features 120.

Figure 3:
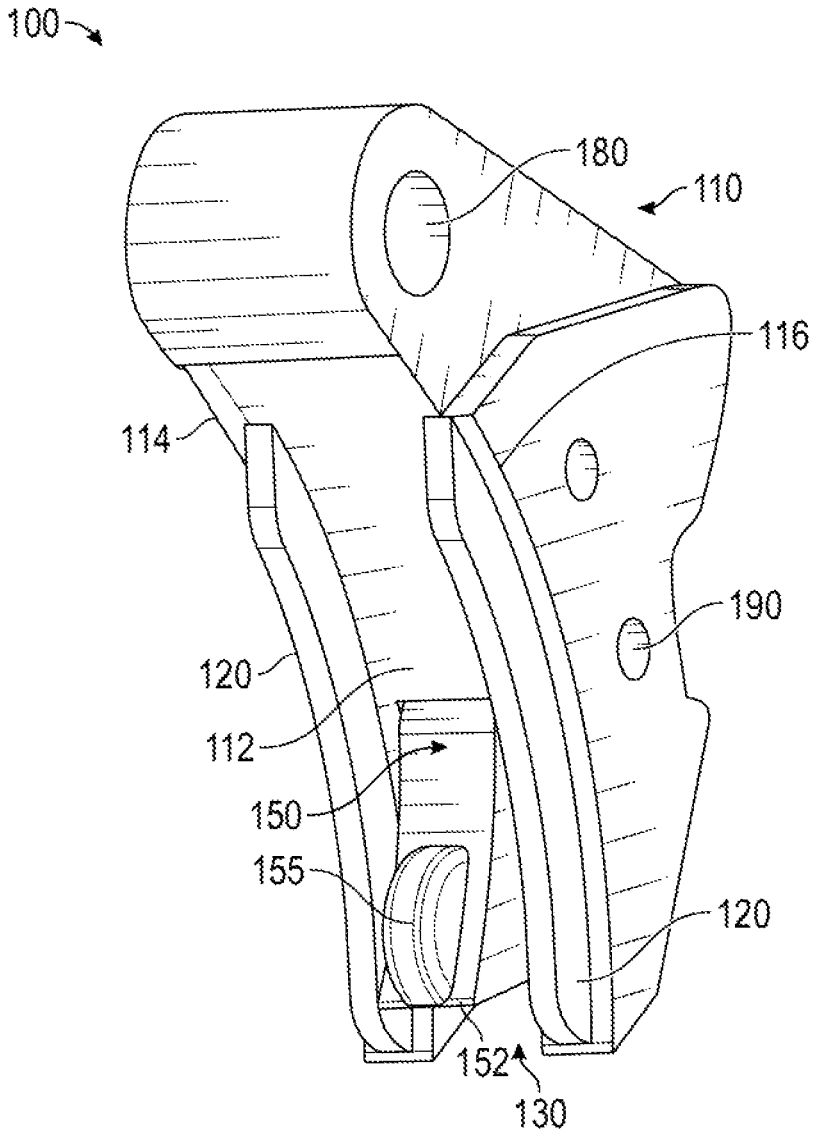
FIG. 3 illustrates a front, side, lower perspective view of a trigger assembly.
Figure 4:
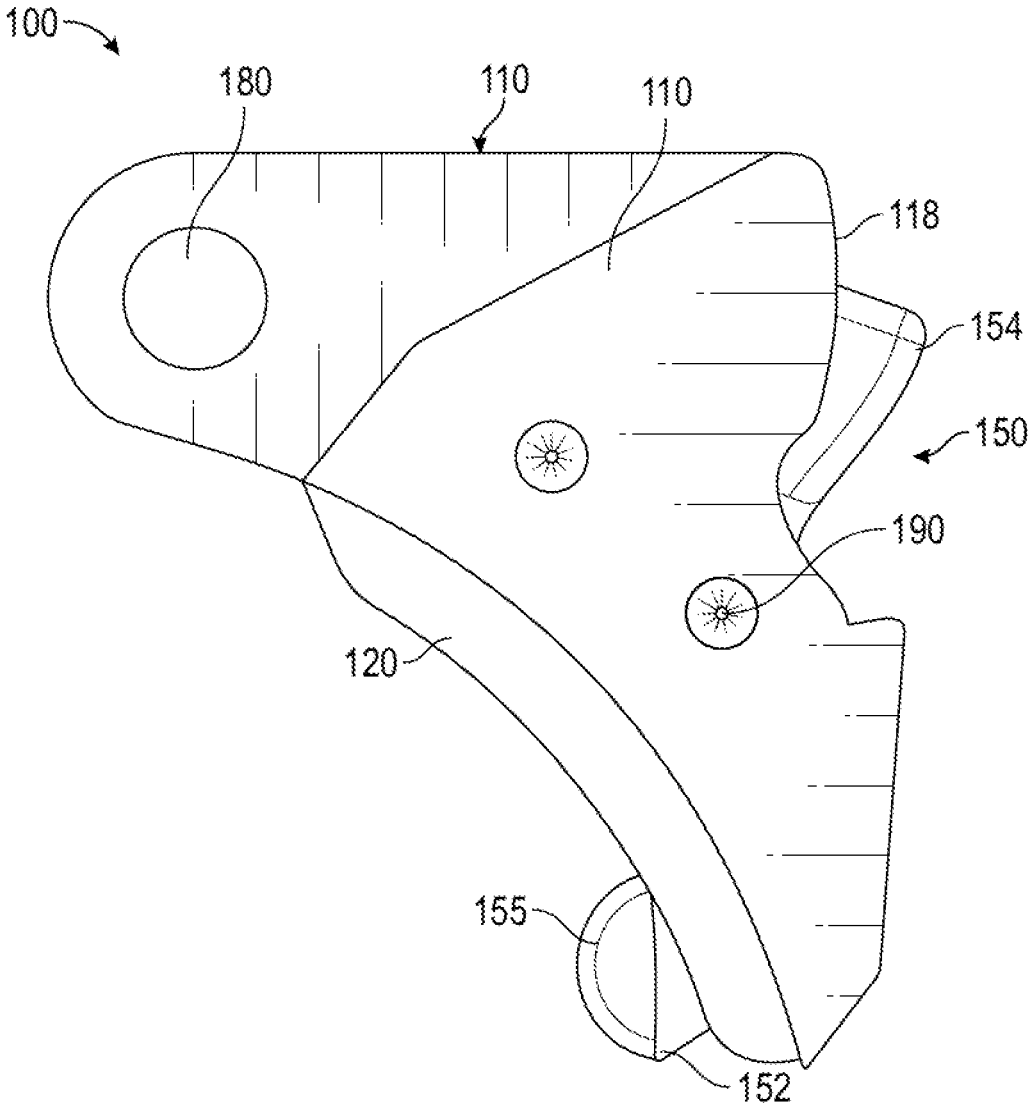
FIG. 4 illustrates a side view of the trigger assembly of FIG. 3.
Figure 5:
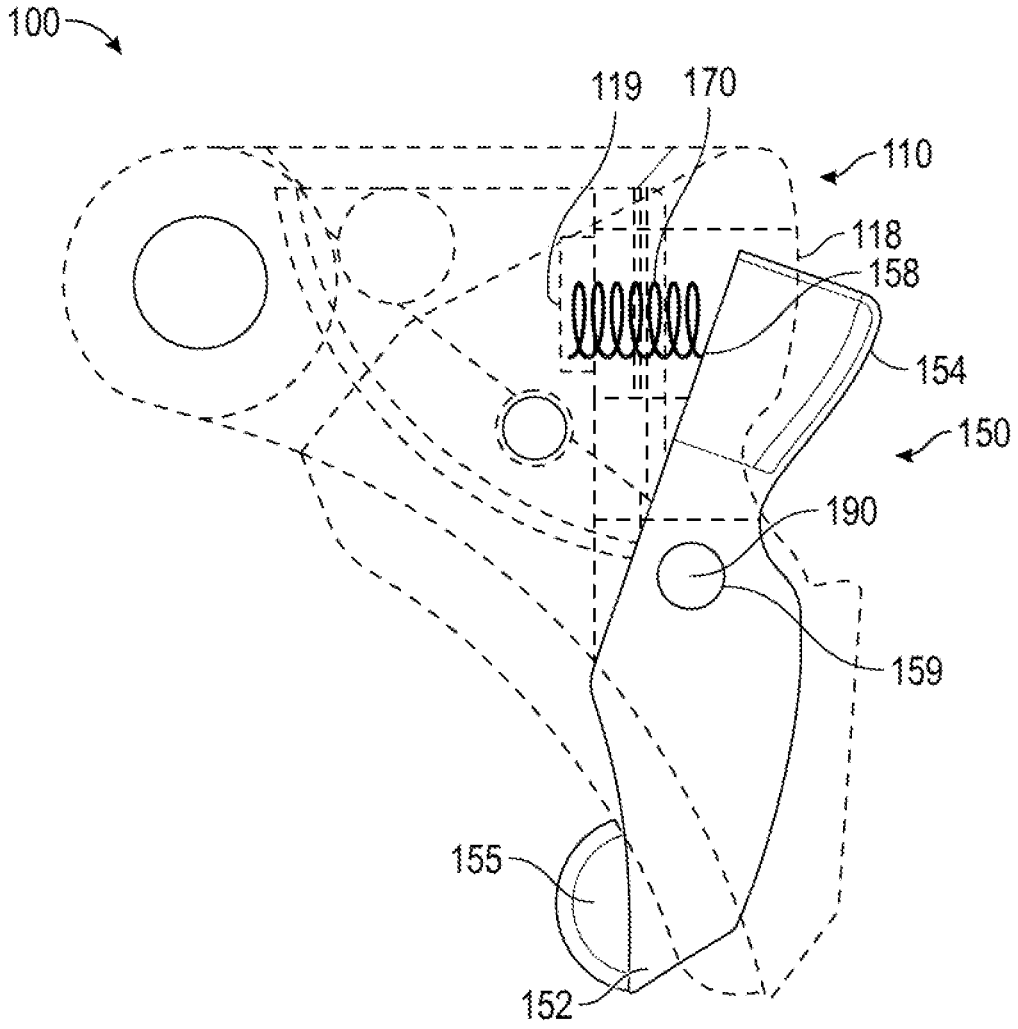
FIG. 5 illustrates a schematic view of the trigger assembly of FIG. 3.

FIGS. 3-5 illustrate the trigger assembly 100 according to one embodiment. The trigger assembly 100 includes a trigger body 110 and a trigger safety member 150 to prevent accidental actuation of the trigger assembly 100. In the illustrated embodiment, the trigger safety member 150 is in an extended position.

Figure 6:
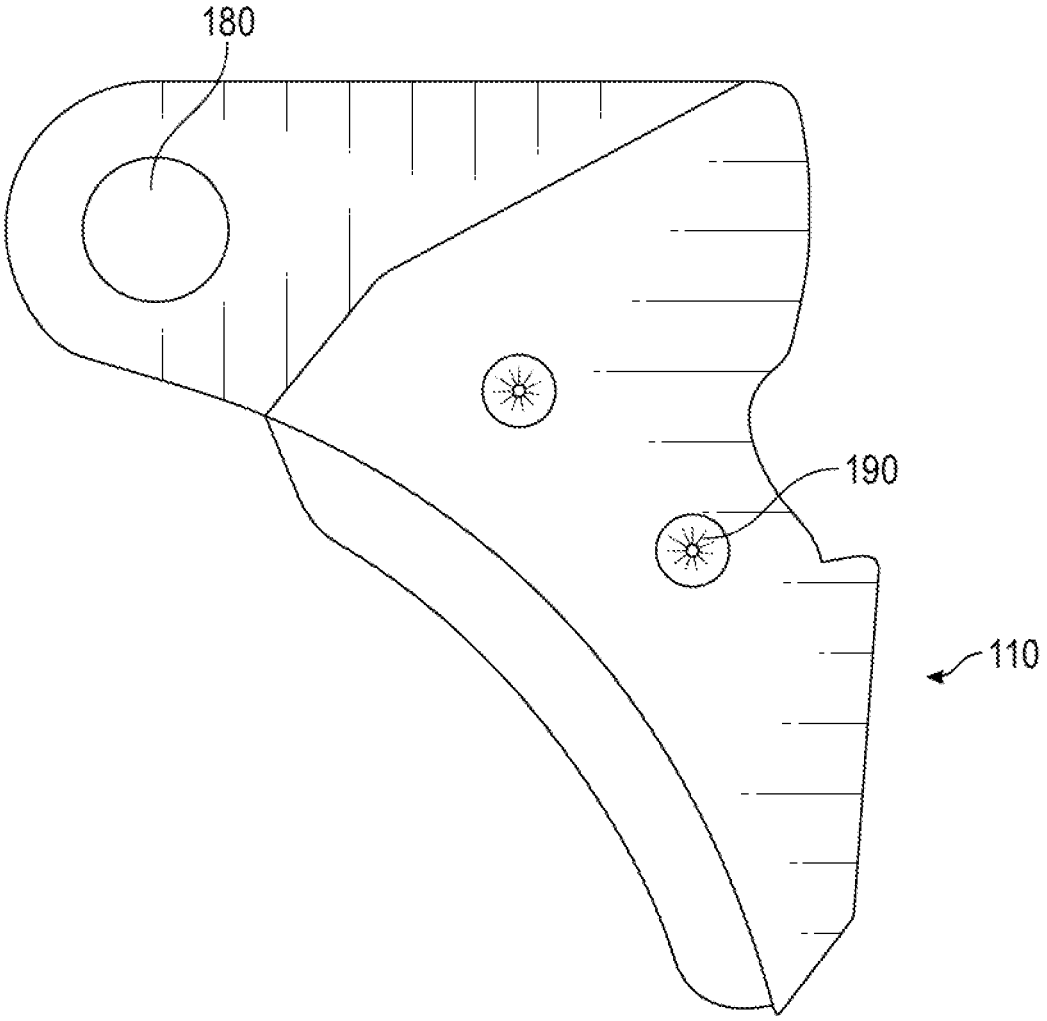
FIG. 6 illustrates a side view of a trigger body.
Figure 7:
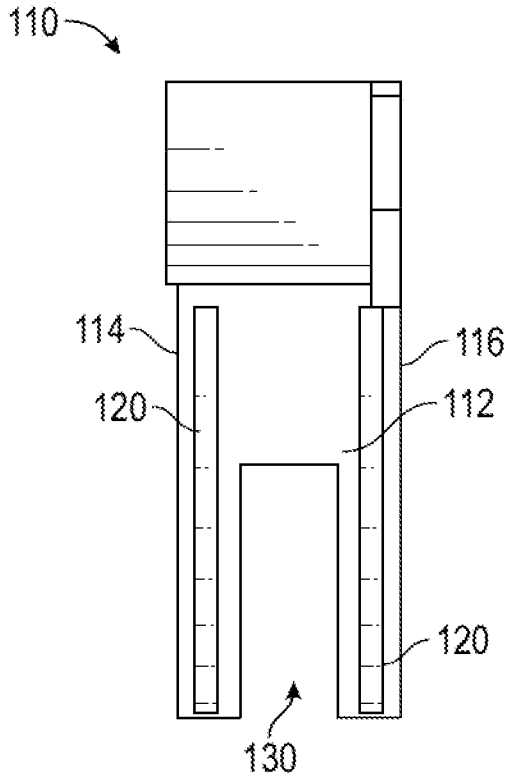
FIG. 7 illustrates a front view of the trigger body of FIG. 6.
Figure 8:
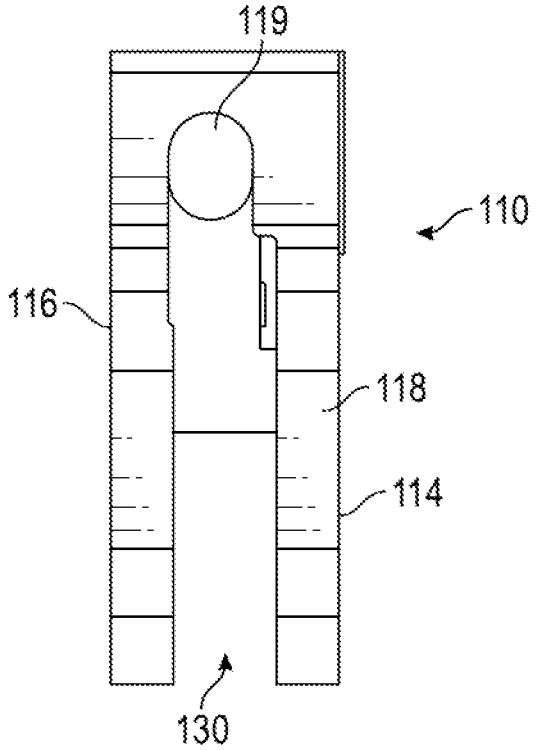
FIG. 8 illustrates a rear view of the trigger body of FIG. 6.

FIGS. 6-8 illustrates the trigger body 110 without the trigger safety member 150. In the illustrated embodiment, the trigger body 110 has a triangular prismatic shape, having a substantially elongated curved shape tapering at one end. In the illustrated embodiment, the trigger body 110 includes a first hole (or bore or passage) 180, through which the trigger body 110 can be pivotally coupled to the firearm housing 220 about an axis extending through the first hole 180 (e.g., using an axle that extends through the bore 180 and connects to the housing 220). In some embodiments, the trigger body 110 includes a second hole (or bore or passage) 190, through which the trigger body 110 can be pivotally coupled with the trigger safety member 150 about an axis extending through the second hole 190, as described herein.

As shown in FIG. 7, the trigger body 110 includes a left edge 114, a right edge 116, and a front surface 112 extending between the left edge 114 and the right edge 116. The trigger body 110 may further include a slot 130 on the front surface 112 between the left edge 114 and the right edge 116. As shown in FIG. 7, the slot 130 may form an opening or cutout at the front surface 112, such that the trigger safety member 150 can extend through the slot 130 and protrude distally of the front surface 112 of the trigger body 110 via the opening or cutout. In some embodiments, the slot 130 may have a rectangular or substantially rectangular shape. The slot 130 may have a width smaller than 70%, smaller than 60%, smaller than 50%, or smaller than 40% of the width of the front surface 112 between the left edge 114 and the right edge 116. The slot 130 may have a width between about 0.1 inches to 0.3 inches. In some embodiments, the slot 130 may have a width of about 0.16 inches. The slot 130 may have a length smaller than 70%, smaller than 60%, smaller than 50%, or smaller than 40% of the length of the front surface 112 perpendicular the width. In some embodiments, the slot 130 can have a length approximately ¼ or less of the length of the front surface 112. In some embodiments, the slot 130 may extend at a central portion of the front surface 112.

As described herein, in some embodiments, the front surface 112 includes the kinesthetic features. In the illustrated embodiment, the front surface 112 includes kinesthetic feature in the form of the pair of protrusions 120. Each of the pair of protrusions 120 is spaced away from each other, and one of the protrusions 120 is proximate the left edge 114, and the other of the pair of protrusions 120 is proximate the right edge 116. Each of the pair of protrusions 120 may extend distally of the front surface 112 substantially parallel to the left edge 114 and the right edge 116. As shown in FIG. 7, a central portion of the front surface 112 may extend between the pair of protrusions 120. The slot 130 may extend between the pair of protrusions 120. As described herein, the pair of protrusions 120 can be engaged by the digit of the user to pull the trigger assembly 100 and provide two points of contact to increase mechanoreceptor stimulation in the digit. The pair of spaced apart protrusions 120 may have enough height, such that they can prevent user contact with the central portion of the front surface 112 of the trigger body 110. In some embodiments, the pair of protrusions 120 extend at least about 0.25 inches above the trigger face. The space between the pair of protrusions 120 can be between about 0.125 inches to about 0.5 inches. Preferably, the pair of protrusions 120 are spaced apart about 0.25 to 0.375 inches. In some embodiments, each of the protrusions 120 may have a thickness between about 0.005 inches and about 0.125 inches. In some embodiments, each of the protrusions 120 have a thickness of about 0.025 inches or less to provide good mechanoreceptor stimulation to a user with or without gloves.

As shown in FIG. 8, the trigger body 110 includes a rear surface 118 opposite the front surface 112, extending between the left edge 114 and the right edge 116. In some embodiments, the slot 130 may extend from the front surface 112 to the rear surface 118, and form an opening or cutout at the rear surface 118, such that the trigger safety member 150 can extend through the slot 130 and protrude proximally of the rear surface 118 of the trigger body 110 via the opening or cutout. In some embodiments, the trigger body 110 further includes a rear receiving portion 119 for receiving a resilient member described herein.

The trigger body 110 may be constructed from any suitable material. In some embodiments, the trigger body 110 can be constructed from polymer. The trigger body 110 may be constructed from glass filled nylon. In some embodiments, the trigger body 110 may be constructed from a metal, such as aluminum or steel. In some embodiments, the trigger body 110 can be constructed from two or more different materials.

Figure 9:
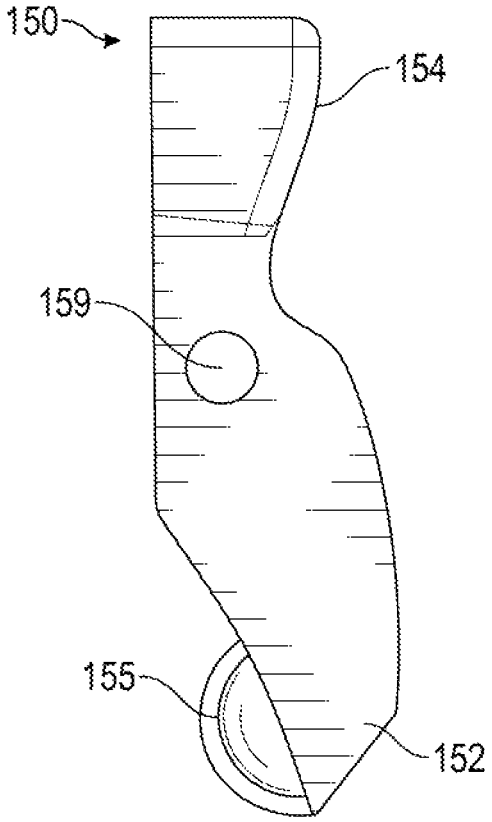
FIG. 9 illustrates a side view of a trigger safety member.
Figure 10:
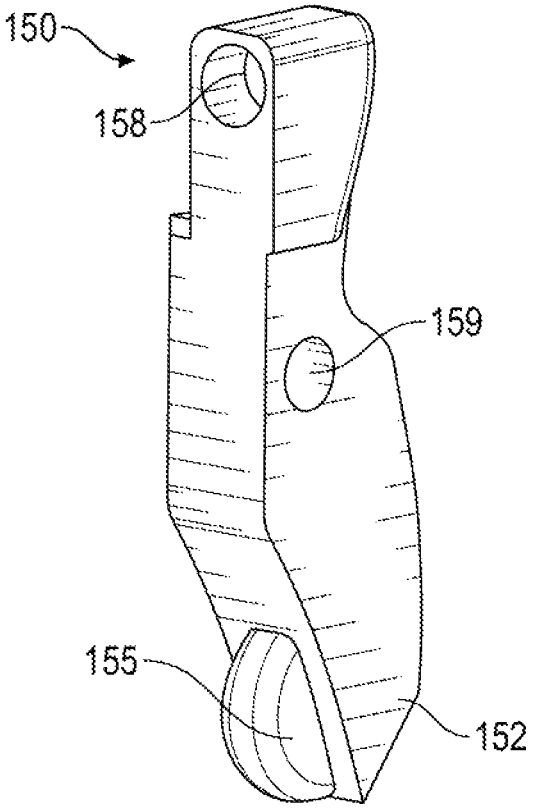
FIG. 10 illustrates a front, side, upper perspective view of the trigger safety member of FIG. 9.

FIGS. 9-10 illustrate the trigger safety member 150 according to one embodiment. In the illustrated embodiment, the trigger safety member 150 has an elongate shape having a length extending from a proximal end 154 to a distal end 152, and includes a hole (or bore or passage) 159, through which the trigger safety member 150 can be pivotally coupled to the trigger body 110 about an axis extending through the hole 159 (e.g., via an axle that extends through the bore 159 and connects with opposite sides of the body of the trigger safety member 150), as described herein. As shown in FIGS. 9-10, the trigger safety member 150 may include a curved surface 155 on a distal surface thereof. In the illustrated embodiment, the curved surface 155 is positioned adjacent the distal end 152. The curved surface 155 may be a convex surface. The curved surface 155 may be a circular surface as shown in FIGS. 9-10 (e.g., semicircular in shape). In some embodiments, the curved surface 155 can be elliptical, or multi-sided. As shown in FIG. 10, the trigger safety member 150 may further include a front receiving portion 158 (e.g., cavity, opening) on a proximal surface of the trigger safety member 150 for receiving a resilient member described herein.

The trigger safety member 150 may be constructed from any suitable material. In some embodiments, the trigger safety member 150 can be constructed from polymer. The trigger safety member 150 may be entirely or partially constructed from glass filled nylon. For example, the curved surface 154 may be constructed from glass filled nylon. In some embodiments, the trigger safety member 150 may be constructed from a metal, such as aluminum or steel. In some embodiments, the trigger safety member 150 can be constructed from two or more different materials.

Turning back to FIGS. 3-5, in the illustrated embodiment, the trigger safety member 150 is in the extended position, and the distal end 152 of the trigger safety member 150 extends through the slot 150 and protrudes distally of (e.g., protrudes in front of) the front surface 112 of the trigger body 110, and the proximal end 154 of the trigger safety member 150 protrudes proximally of (e.g., protrudes rearwardly of) the rear surface 118 of the trigger body 110. When the trigger assembly 100 is assembled with the firearm housing 220, the proximal end 154 of the trigger safety member 150 protruding proximally of the rear surface 118 of the trigger body 110 can inhibit pivoting of the trigger body 110 relative to the firearm housing 220 past a predetermined position, as described in further detail herein, for example in relation to FIG. 11.

FIG. 5 illustrates the trigger safety member 150 positioned within the trigger body 110 when they are assembled together. As shown in FIG. 5, the hole (or bore or passage) 159 of the trigger safety member 150 can be aligned with the second hole (or bore) 190 of the trigger body 110, such that the trigger body 110 can be pivotally coupled with the trigger safety member 150 about an axis extending through the second hole 190 and the hole 159. In some embodiments, the trigger assembly 100 may include a shaft (or axle) extending through the second hole 190 and the hole 159, such that the trigger safety member 150 can rotate about the shaft.

In some embodiments, the trigger assembly 100 may include a resilient member 170. The resilient member 170 can be positioned between a portion of the trigger body 110 and a portion of the trigger safety member 150, and bias the trigger safety member 150 in a first direction (e.g. clockwise direction in FIG. 5) to the extended position, As described herein, in the extended position, the distal end 152 of the trigger safety member 150 extends through the slot 130 and protrudes distally of the front surface 112 and the proximal end 154 of the trigger safety member 150 protrudes proximally of the rear surface 118 of the trigger body 110. In some embodiments, the resilient member 170 can be disposed between a proximal portion of the trigger safety member 150 adjacent the proximal end 154 of the trigger safety member and a portion of the trigger body 110. For example, the resilient member 170 can be positioned between the rear receiving portion 119 of the trigger body 110 and the front receiving portion 158 of the trigger safety member 150. In the illustrated embodiment, the resilient member 170 is a spring, for example a coil spring. However, the resilient member 170 may not be limited, and may be selected from any resilient material which can provide elastic force to the trigger safety member 150 to bias the trigger safety member 150 in one direction.

Figure 11:
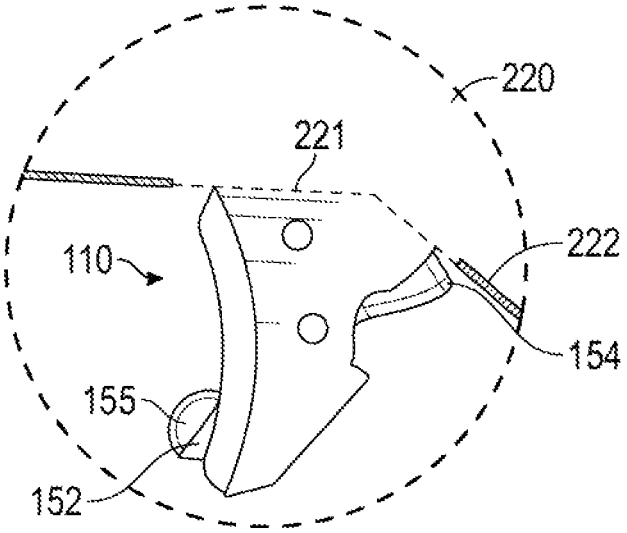
FIG. 11 illustrates a side view of a trigger assembly on a firearm weapon.

FIG. 11 schematically illustrates the trigger assembly 100 coupled with the firearm housing 220 at a trigger opening 221 formed at the firearm housing 220. As described herein, when the trigger assembly 100 is assembled with the firearm housing 220, the proximal end 154 of the trigger safety member 150 protruding proximally of the rear surface 118 of the trigger body 110 can inhibit pivoting of the trigger body 110 relative to the firearm housing 220 past a predetermined position. When an external force which pulls the trigger body 110 in the proximal direction is exerted on the trigger body 110, the trigger body 110 may tend to pivot relative to the firearm housing 220. However, the proximal end 154 of the trigger safety member 150 may interfere with the outer surface of the firearm housing 220, and the pivoting of the trigger body 110 past the predetermined position can be inhibited, such that the firearm weapon is not fired. For example, the trigger opening 221 may have enough width to receive the trigger body 110 when the trigger body 110 pivots relative to the firearm housing 220, but the trigger opening 221 may be smaller than the combined width of the trigger body 110 and the proximal end 154 of the trigger safety member 150, such that the proximal end 154 of the trigger safety member 150 may interfere with a portion 222 of the firearm housing 220 located proximally to the trigger assembly 100 adjacent the trigger opening 221. Such interference would inhibit (e.g., prevent) the movement of the trigger body 110 to cause a shot (e.g., cause a bullet to be shot from the firearm) when the trigger safety member 150 is in the extended position, as shown in FIGS. 3-5 and 11. In some embodiments, the firearm housing 220 may additionally or alternatively include an internal structure to interfere with a portion of the trigger safety member 150 to prevent pivoting of the trigger body 110 past the predetermined position.

Figure 12:
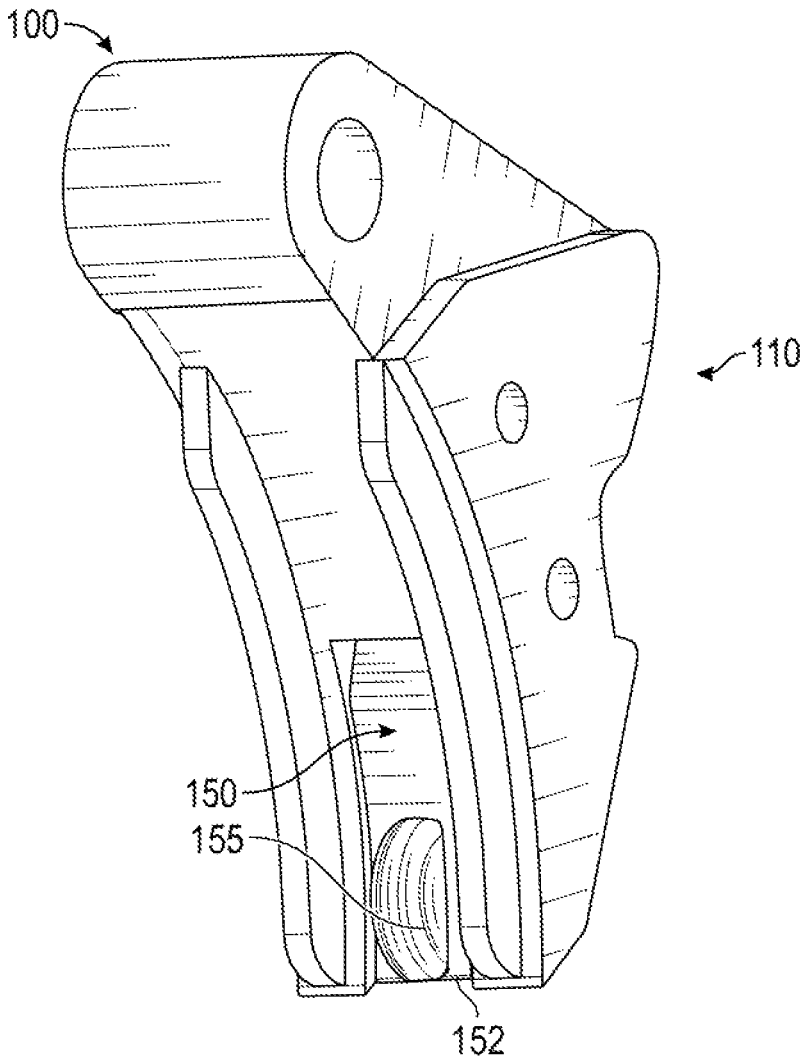
FIG. 12 illustrates a front, side, lower perspective view of a trigger assembly.
Figure 13:
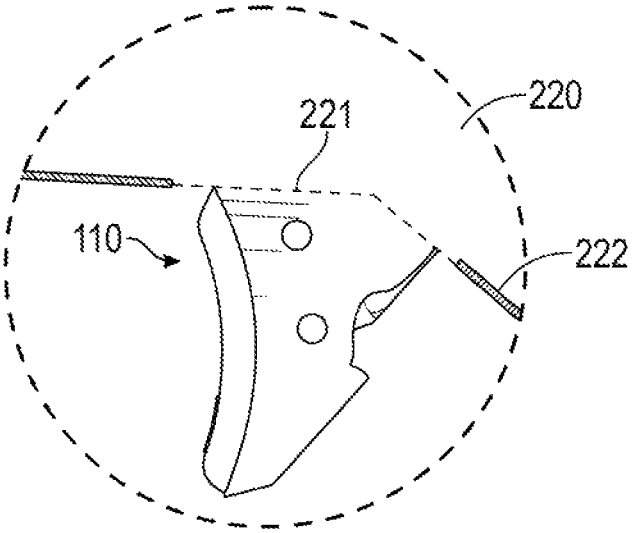
FIG. 13 illustrates a side view of a trigger assembly on a firearm weapon.

FIG. 12 illustrates the trigger assembly 100 when the trigger safety member 150 is engaged (e.g., in the depressed or retracted position), and FIG. 13 schematically illustrates the trigger assembly 100 coupled with the firearm housing 220 at the trigger opening 221 when the trigger safety member 150 is engaged (e.g., in the depressed or retracted position). When the user tries to pull on the trigger, the trigger safety member 150 of the trigger assembly 100 in the extended position is engaged by the digit of the user, the trigger safety member 150 can pivot in a second direction (e.g. counter-clockwise direction in FIG. 13) opposite the first direction about the axis extending through the second hole 190 and the hole 159, and the proximal end 154 of the trigger safety member 150 can move in distal direction into the rear surface 118 of the trigger body 110, such that the resilient member 170 is suppressed and the proximal end 154 less protrudes or no longer protrudes proximally of the rear surface 118 of the trigger body 110, thus no longer interfere with the portion 222 of the firearm housing 220, as shown in FIG. 13. That is, when the trigger safety member 150 is pressed by the user's digit, it is moved (pivoted) into a depressed or retracted position relative to the trigger body 110, allowing the trigger body 110 to fully travel within the firearm housing 220 to cause a shot to be taken with the firearm. Accordingly, the trigger body 110 can pivot past the predetermined position into the firearm housing 220 through the trigger opening 221 when the trigger body 110 is pulled, allowing firing of the firearm weapon. When the trigger safety member 150 is no longer engaged by the digit of the user, the elastic force of the resilient member 170 (e.g., coil spring) can bias the trigger safety member 150 in the first direction, returning the trigger safety member 170 to the extended position.

In some embodiments, the trigger safety member 150 is engaged by the digit of the user by engaging a distal portion adjacent the distal end of the trigger safety member 150, for example, the curved surface 155, by the digit of the user. The curved surface 155 and/or the distal portion of the trigger safety member 150 needs to protrude in front of the front surface 112 in the extended position, to be engaged by the digit of the user. In some embodiments, the curved surface 155, the distal portion, and/or the distal end 152 of the trigger safety member 150 protrudes past the pair of spaced part protrusions 120 in the extended position. However, in some implementations, if the trigger safety member 150 protrudes too much in front of the front surface 112, the chance of unintentionally engaging of the trigger safety member 150 may increase, and thus it may be desired that the protrusion of the trigger safety member 150 in front of the front surface 112 is limited. The curved surface 155 may facilitate engaging of the trigger safety member 150 by increasing the contact surface area, even when the length of the protruded portion of the trigger safety member 150 is limited. In some embodiments, a portion of the trigger safety member 150 that protrudes in front of the front surface 112 in the extended position has a length that is approximately ¼ or less of a length (e.g., an entire length) of the front surface 112 of the trigger body 110. In some embodiments, the portion of the trigger safety member 150 that protrudes in front of the front surface 112 in the extended position has a length that is approximately ½ or less, ⅓ or less, ¼ or less, or ⅕ or less of a length (e.g., entire length) of the front surface 112 of the trigger body 110. The portion of the trigger safety member 150 that protrudes in front of the front surface 112 in the extended position may have has a length that is approximately smaller than 70%, smaller than 60%, smaller than 50%, or smaller than 40% of the length of the front surface 112. In some embodiments, the trigger safety member 150 protrudes at a lower portion of the front surface adjacent a lower end of the front surface 112. For example, the trigger safety member 150 only protrudes in front of the lower half or the lower third of the front surface 112.

In some embodiments, a method of firing a firearm weapon can include a number of steps. This can include placing a digit adjacent to the front surface 112 of the trigger assembly 100, where the trigger assembly 100 further includes the trigger safety member 150. The user may next engage the digit with the portion of the trigger safety member 150 in the extended position, protruding in front of the front surface 112. The digit may engage the curved surface 155, the distal end 152 of the trigger safety member 150, and/or the distal portion adjacent the distal end 152. After the trigger safety member 150 engaged, the trigger safety member 150 can pivot relative to the trigger body 110 as described herein, and the trigger body 110 is no longer inhibited to pivot relative to the firearm housing 220. Then the user may pull on the trigger body 110 to fire the firearm weapon.

As used herein, "kinesthetic feedback" means sensory (i.e., tactile) return to the subject or operator of a part of the output from digit pressure on the surface of a trigger of a weapon. For example, the use of the trigger as disclosed for a subject shooter, kinesthetic feedback refers to the return of tactile information about the even rearward pull (or lack thereof) of a trigger, where for the trigger of the instant disclosure, kinesthetic feedback would be similar to that of a pin (sharp surface) versus that of a planar surface (dull surface), where the sensory output from placement of a digit on the sharp surface would make the subject more acutely aware of any increase in pressure against said pin relative to the placement of the same digit on a dull or substantially planar surface.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

Similarly, this method of disclosure, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

Additional Embodiments

In embodiments of the present invention, a trigger assembly, and a firearm, may be in accordance with any of the following clauses:

Clause 1. A trigger assembly comprising:

a trigger body having an elongated shape with a front surface that extends across a width between a left edge and a right edge, the trigger body configured to be pivotally coupled to a firearm housing, and the trigger body having a slot between the left edge and the right edge;

a trigger safety member pivotally coupled to the trigger body, the trigger safety member extending between a proximal end and a distal end, the distal end comprising a curved surface configured to be engaged by a digit of a user to allow pivoting of the trigger body when pulling on the trigger; and a resilient member disposed between a portion of the trigger body and a portion of the trigger safety member, the resilient member configured to bias the trigger safety member in a first direction to an extended position such that the distal end of the trigger safety member extends through the slot and protrudes distally of the front surface and the proximal end of the trigger safety member protrudes proximally of a rear surface of the trigger body to inhibit pivoting of the trigger body relative to the firearm housing past a predetermined position, wherein when engaged by the digit of the user, the trigger safety member is configured to pivot in a second direction opposite the first direction to allow the trigger body to pivot past the predetermined position when pulling the trigger.

Clause 2. The trigger assembly of clause 1, wherein the curved surface is a convex surface.

Clause 3. The trigger assembly of clause 2, wherein the convex surface is a circular surface.

Clause 4. The trigger assembly of any preceding clause, wherein the resilient member comprises a spring.

Clause 5. The trigger assembly of clause 4, wherein the spring is a coil spring.

Clause 6. The trigger assembly of clause 4 or 5, wherein the resilient member is disposed between a proximal portion of the trigger safety member adjacent the proximal end of the trigger safety member and a portion of the trigger body.

Clause 7. The trigger assembly of any preceding clause, wherein the trigger safety member is pivotally coupled to the trigger body about a first axis.

Clause 8. The trigger assembly of any preceding clause, wherein the trigger body comprises a pair of spaced apart protrusions that extend distally of the front surface of the trigger body, so that a central portion of the front surface extends between the pair of protrusions and so that the slot extends between the pair of protrusions, wherein the pair of spaced apart protrusions are configured to be engaged by the digit of the user to pull the trigger and provide two points of contact to increase mechanoreceptor stimulation in the digit.

Clause 9. The trigger assembly of clause 8, wherein one of the pair of spaced apart protrusions is proximate the left edge and the other of the pair of spaced apart protrusions is proximate the right edge, and wherein the pair of spaced apart protrusions are configured to prevent user contact with the central portion of the front surface of the trigger body.

Clause 10. The trigger assembly of clause 9, wherein the distal end of the trigger safety member protrudes past the pair of spaced apart protrusions in the extended position.

Clause 11. The trigger assembly of any preceding clause, wherein a portion of the trigger safety member that protrudes in front of the front surface in the extended position has a length that is approximately ¼ or less of a length of the front surface of the trigger body.

Clause 12. The trigger assembly of any preceding clause, wherein the trigger safety member protrudes in front of a lower portion of the front surface adjacent a lower end of the front surface of the trigger body.

Clause 13. The trigger assembly of any preceding clause, wherein the trigger safety member comprises glass filled nylon.

Clause 14. A firearm comprising:

a firearm housing;

a trigger body having an elongated shape with a front surface that extends across a width between a left edge and a right edge, the trigger body configured to be pivotally coupled to the firearm housing, and the trigger body having a slot between the left edge and the right edge;

a trigger safety member pivotally coupled to the trigger body, the trigger safety member extending between a proximal end and a distal end, the distal end comprising a curved surface configured to be engaged by a digit of a user to allow pivoting of the trigger body when pulling on the trigger; and a resilient member disposed between a portion of the trigger body and a portion of the trigger safety member, the resilient member configured to bias the trigger safety member in a first direction to an extended position such that the distal end of the trigger safety member extends through the slot and protrudes distally of the front surface and the proximal end of the trigger safety member protrudes proximally of a rear surface of the trigger body to inhibit pivoting of the trigger body relative to the firearm housing past a predetermined position, wherein when engaged by the digit of the user, the trigger safety member is configured to pivot in a second direction opposite the first direction to allow the trigger body to pivot past the predetermined position when pulling the trigger.

Clause 15. The firearm of clause 14, wherein the curved surface is a convex surface.

Clause 16. The firearm of clause 15, wherein the convex surface is a circular surface.

Clause 17. The firearm of any of clauses 14-16, wherein the resilient member comprises a spring.

Clause 18. The firearm of clause 17, wherein the spring is a coil spring.

Clause 19. The firearm of clause 17 or 18, wherein the resilient member is disposed between a proximal portion of the trigger safety member adjacent the proximal end of the trigger safety member and a portion of the trigger body.

Clause 20. The firearm of any of clauses 14-19, wherein the trigger safety member is pivotally coupled to the trigger body about a first axis.

Clause 21. The firearm of any of clauses 14-20, wherein the trigger body comprises a pair of spaced apart protrusions that extend distally of the front surface of the trigger body, so that a central portion of the front surface extends between the pair of protrusions and so that the slot extends between the pair of protrusions, wherein the pair of spaced apart protrusions are configured to be engaged by the digit of the user to pull the trigger and provide two points of contact to increase mechanoreceptor stimulation in the digit.

Clause 22. The firearm of clause 21, wherein one of the pair of spaced apart protrusions is proximate the left edge and the other of the pair of spaced apart protrusions is proximate the right edge, and wherein the pair of spaced apart protrusions are configured to prevent user contact with the central portion of the front surface of the trigger body.

Clause 23. The firearm of clause 22, wherein the distal end of the trigger safety member protrudes past the pair of spaced apart protrusions in the extended position.

Clause 24. The firearm of any of clauses 14-23, wherein a portion of the trigger safety member that protrudes in front of the front surface in the extended position has a length that is approximately ¼ or less of a length of the front surface of the trigger body.

Clause 25. The firearm of any of clauses 14-24, wherein the trigger safety member protrudes in front of a lower portion of the front surface adjacent a lower end of the front surface of the trigger body.

Clause 26. The firearm of any of clauses 14-25, wherein the trigger safety member comprises glass filled nylon.

What is claimed is:

1. A trigger assembly comprising:

a trigger body having an elongated shape with a front surface that extends across a width between a left edge and a right edge, the trigger body configured to be pivotally coupled to a weapon housing, and the trigger body having a slot between the left edge and the right edge;

a trigger safety member pivotally coupled to the trigger body, the trigger safety member extending between a proximal end and a distal end, the distal end comprising a curved surface configured to be engaged by a digit of a user to allow pivoting of the trigger body when pulling on the trigger; and a resilient member disposed between a portion of the trigger body and a portion of the trigger safety member, the resilient member configured to bias the trigger safety member in a first direction to an extended position such that the distal end of the trigger safety member extends through the slot and protrudes distally of a distal-most contact portion of the trigger body in front of a lower portion of the trigger body, and adjacent a lower end the trigger body, and the proximal end of the trigger safety member protrudes proximally of a rear surface of the trigger body to inhibit pivoting of the trigger body relative to the weapon housing past a predetermined position, wherein when engaged by the digit of the user, the trigger safety member is configured to pivot in a second direction opposite the first direction to allow the trigger body to pivot past the predetermined position when pulling the trigger.

2. The trigger assembly of claim 1, wherein the curved surface is a convex surface.

3. The trigger assembly of claim 2, wherein the convex surface is a circular surface.

4. The trigger assembly of claim 1, wherein the resilient member comprises a spring.

5. The trigger assembly of claim 4, wherein the spring is a coil spring.

6. The trigger assembly of claim 4, wherein the resilient member is disposed between a proximal portion of the trigger safety member adjacent the proximal end of the trigger safety member and a portion of the trigger body.

7. The trigger assembly of claim 1, wherein the trigger safety member is pivotally coupled to the trigger body about a first axis.

8. The trigger assembly of claim 1, wherein the trigger body comprises a pair of spaced apart protrusions comprising the distal-most contact portion of the trigger body, that extend distally of the front surface of the trigger body, so that a central portion of the front surface extends between the pair of protrusions and so that the slot extends between the pair of protrusions, wherein the pair of spaced apart protrusions are configured to be engaged by the digit of the user to pull the trigger and provide two points of contact to increase mechanoreceptor stimulation in the digit.

9. The trigger assembly of claim 8, wherein one of the pair of spaced apart protrusions is proximate the left edge and the other of the pair of spaced apart protrusions is proximate the right edge, and wherein the pair of spaced apart protrusions are configured to prevent user contact with the central portion of the front surface of the trigger body.

10. The trigger assembly of claim 9, wherein the distal end of the trigger safety member protrudes past the pair of spaced apart protrusions in the extended position.

11. The trigger assembly of claim 1, wherein a portion of the trigger safety member that protrudes in front of the distal-most contact portion of the trigger body in the extended position has a length that is ¼ or less of a length of the front surface of the trigger body.

12. The trigger assembly of claim 1, wherein the trigger safety member comprises glass filled nylon.

13. A weapon comprising:

a weapon housing;

a trigger body having an elongated shape with a front surface that extends across a width between a left edge and a right edge, the trigger body configured to be pivotally coupled to the weapon housing, and the trigger body having a slot between the left edge and the right edge;

a trigger safety member pivotally coupled to the trigger body, the trigger safety member extending between a proximal end and a distal end, the distal end comprising a curved surface configured to be engaged by a digit of a user to allow pivoting of the trigger body when pulling on the trigger; and a resilient member disposed between a portion of the trigger body and a portion of the trigger safety member, the resilient member configured to bias the trigger safety member in a first direction to an extended position such that the distal end of the trigger safety member extends through the slot and protrudes distally of a distal-most contact portion of the trigger body in front of a lower portion of the trigger body, and adjacent a lower end the trigger body, and the proximal end of the trigger safety member protrudes proximally of a rear surface of the trigger body to inhibit pivoting of the trigger body relative to the weapon housing past a predetermined position, wherein when engaged by the digit of the user, the trigger safety member is configured to pivot in a second direction opposite the first direction to allow the trigger body to pivot past the predetermined position when pulling the trigger.

14. The weapon of claim 13, wherein the curved surface is a convex surface.

15. The weapon of claim 14, wherein the convex surface is a circular surface.

16. The weapon of claim 13, wherein the resilient member comprises a spring.

17. The weapon of claim 16, wherein the spring is a coil spring.

18. The weapon of claim 16, wherein the resilient member is disposed between a proximal portion of the trigger safety member adjacent the proximal end of the trigger safety member and a portion of the trigger body.

19. The weapon of claim 13, wherein the trigger safety member is pivotally coupled to the trigger body about a first axis.

20. The weapon of claim 13, wherein the trigger body comprises a pair of spaced apart protrusions comprising the distal-most contact portion of the trigger body, that extend distally of the front surface of the trigger body, so that a central portion of the front surface extends between the pair of protrusions and so that the slot extends between the pair of protrusions, wherein the pair of spaced apart protrusions are configured to be engaged by the digit of the user to pull the trigger and provide two points of contact to increase mechanoreceptor stimulation in the digit.

21. The weapon of claim 20, wherein one of the pair of spaced apart protrusions is proximate the left edge and the other of the pair of spaced apart protrusions is proximate the right edge, and wherein the pair of spaced apart protrusions are configured to prevent user contact with the central portion of the front surface of the trigger body.

22. The weapon of claim 21, wherein the distal end of the trigger safety member protrudes past the pair of spaced apart protrusions in the extended position.

23. The weapon of claim 13, wherein a portion of the trigger safety member that protrudes in front of the distal-most contact portion of the trigger body in the extended position has a length that is ¼ or less of a length of the front surface of the trigger body.

24. The weapon of claim 13, wherein the trigger safety member comprises glass filled nylon.

* * * * *